US012336644B2

(12) United States Patent
Milewski

(10) Patent No.: US 12,336,644 B2
(45) Date of Patent: Jun. 24, 2025

(54) WORKSTATION

(71) Applicant: Tyler Alexander Milewski, Ottawa (CA)

(72) Inventor: Tyler Alexander Milewski, Ottawa (CA)

(73) Assignee: Tyler Alexander Milewski, Ottawa (CA)

( * ) Notice: Subject to any disclaimer, the term of this patent is extended or adjusted under 35 U.S.C. 154(b) by 0 days.

(21) Appl. No.: 18/055,178

(22) Filed: Nov. 14, 2022

(65) Prior Publication Data

US 2024/0156268 A1 May 16, 2024

(51) Int. Cl.

| | |
|---|---|
| ***A47C 7/50*** | (2006.01) |
| ***A47B 83/02*** | (2006.01) |
| ***A47C 1/024*** | (2006.01) |
| ***A47C 1/03*** | (2006.01) |
| ***A47C 7/68*** | (2006.01) |
| ***A47C 7/70*** | (2006.01) |
| ***A47C 7/72*** | (2006.01) |

(52) U.S. Cl.

CPC ..... *A47C 7/723* (2018.08); *A47B 83/02* (2013.01); *A47C 1/024* (2013.01); *A47C 1/03* (2013.01); *A47C 7/506* (2013.01); *A47B 2083/025* (2013.01); *A47C 7/68* (2013.01); *A47C 7/70* (2013.01)

(58) Field of Classification Search

CPC ..... A47B 2083/025; A47C 7/723
USPC ..... 297/160, 161, 162, 173
See application file for complete search history.

(56) References Cited

U.S. PATENT DOCUMENTS 4,097,087 A * 6/1978 Garavaglia ..... A47C 7/46 297/284.7
4,649,580 A * 3/1987 Bastien ..... A45D 19/10 4/523
4,696,516 A * 9/1987 Yeum ..... A47C 7/46 297/452.37
4,779,922 A * 10/1988 Cooper ..... A47B 21/03 248/920

(Continued)

FOREIGN PATENT DOCUMENTS

CN 110089870 A * 8/2019 ..... A47C 7/002
CN 112741437 A * 5/2021 ..... A47C 1/02

(Continued)

*Primary Examiner* — Rodney B White
(74) *Attorney, Agent, or Firm* — Argus Intellectural Enterprise, LLC; Jordan Sworen; Daniel Enea

(57) ABSTRACT

A workstation is presented. In one embodiment, the workstation comprises a backrest angularly coupled to a seat at a designated recline angle, the backrest comprising a raised spine rest portion, centered laterally in the middle of said backrest, and extending longitudinally along a designated length of said backrest; the spine rest portion further comprises a recessed channel portion therein for receiving one or more spinous processes of the user therein, a neck rest comprising one of more vibrating nodes thereon configured to engage with the back of the user's neck; and a footrest adjustably tilted and coupled to said base, the footrest having two vibrating nodes thereon, each vibrating node positioned for receiving the ball of a foot of the user thereon; a display mount rigidly coupled to the back of the backrest; a keyboard mount and a mouse platform.

20 Claims, 10 Drawing Sheets

(56) References Cited

U.S. PATENT DOCUMENTS 4,835,801 A * 6/1989 Walpin ..... A47C 7/425 297/452.32
4,880,270 A * 11/1989 Cooper ..... F16M 11/24 297/188.21
4,915,450 A 4/1990 Cooper
5,056,864 A * 10/1991 Cooper ..... F16M 11/10 297/188.21
5,116,098 A * 5/1992 Wooten ..... A47B 83/02 297/170
5,177,820 A * 1/1993 Varallo ..... A47C 1/10 4/522
5,251,956 A * 10/1993 Hofmeyer ..... A47C 7/68 297/173
5,311,210 A * 5/1994 O'Brien ..... H01H 13/84 400/486
5,458,395 A * 10/1995 Skarda, Jr. ..... A47C 7/622 297/173 X
5,542,746 A * 8/1996 Bujaryn ..... A47C 9/005 297/301.1
5,584,596 A * 12/1996 Greene ..... F16M 11/08 294/135
5,588,697 A * 12/1996 Yoshida ..... A47B 13/16 297/173 X
5,624,312 A * 4/1997 Collier ..... F24F 7/08 454/247
5,653,499 A * 8/1997 Goodall ..... A47B 83/02 297/173
5,743,503 A * 4/1998 Voeller ..... F16M 11/2014 248/920
5,765,910 A * 6/1998 Larkin ..... A47B 83/001 297/173
5,765,911 A * 6/1998 Sorenson ..... A47C 7/70 297/173 X
5,779,305 A * 7/1998 Hocking ..... A47C 7/725 297/188.21
5,873,624 A * 2/1999 Simpson ..... A47C 7/70 297/173 X
5,909,864 A * 6/1999 Wang ..... A47B 83/02 297/173
6,056,363 A * 5/2000 Maddox ..... A47C 1/024 297/161
6,092,868 A * 7/2000 Wynn ..... A47C 7/723 297/188.05
6,102,476 A * 8/2000 May ..... A47B 21/00 297/217.3
6,158,808 A * 12/2000 Margolis ..... A47C 1/025 297/423.35
6,224,149 B1 * 5/2001 Gevaert ..... A47C 7/70 297/162
6,237,997 B1 * 5/2001 Olson ..... A47C 7/70 297/162
6,315,358 B1 * 11/2001 Baru ..... A47B 83/001 297/170
6,439,657 B1 * 8/2002 Tholkes ..... A47B 9/02 297/172 X
6,450,161 B1 * 9/2002 Izumi ..... F24C 1/16 297/173
6,450,578 B1 * 9/2002 Taggett ..... A47C 7/72 297/423.38
6,609,691 B2 * 8/2003 Oddsen, Jr. ..... F16M 11/2092 248/278.1
6,644,748 B2 * 11/2003 Tholkes ..... A47B 9/00 297/172 X
6,695,270 B1 * 2/2004 Smed ..... F16M 11/2092 248/278.1
6,702,373 B2 * 3/2004 Rossko ..... A47C 7/68 297/173
6,712,008 B1 * 3/2004 Habenicht ..... A47B 21/0314 108/50.01
6,736,364 B2 * 5/2004 Oddsen, Jr. ..... F16M 11/2014 248/278.1
7,134,719 B2 * 11/2006 Moglin ..... A47C 7/72 297/188.21
7,159,827 B2 * 1/2007 Bombelli ..... A47B 21/0371 248/118.1
7,322,653 B2 * 1/2008 Dragusin ..... A47C 7/72 297/301.2
7,762,626 B2 * 7/2010 Le ..... A47C 1/04 297/173
7,887,130 B1 * 2/2011 Zvolena ..... A47C 9/002 297/260.2
7,922,249 B2 * 4/2011 Marchand ..... A47B 83/001 297/148
8,087,724 B2 1/2012 Kosik et al.
8,109,566 B2 * 2/2012 Koh ..... A47B 83/02 297/173 X
8,141,949 B2 * 3/2012 Baru ..... F16M 11/18 297/217.3
8,939,500 B2 * 1/2015 Voigt ..... A47C 7/72 297/217.3
8,955,905 B2 * 2/2015 Boenigk ..... A47C 7/70 297/173
9,220,348 B2 12/2015 Stieler et al.
9,433,288 B2 9/2016 Voigt et al.
9,955,785 B2 * 5/2018 Voigt ..... A47C 1/0242
10,512,331 B2 12/2019 Zhang
10,736,419 B2 * 8/2020 Koulizakis ..... A47C 7/723
11,219,311 B1 * 1/2022 Kondziela ..... A47B 83/02
11,253,076 B2 * 2/2022 Motley ..... A47C 7/44
11,730,269 B1 * 8/2023 Rosebrook ..... A47C 7/5064 297/423.12
11,844,434 B2 * 12/2023 Catan ..... A47C 9/002
2001/0020810 A1 9/2001 Kennedy
2002/0043827 A1 * 4/2002 Baru ..... A47C 7/723 297/170
2003/0073552 A1 * 4/2003 Knight ..... A47C 9/002 482/148
2004/0155493 A1 * 8/2004 Baru ..... A47C 7/72 297/188.2
2006/0060735 A1 * 3/2006 Oddsen, Jr. ..... F16M 11/2064 248/278.1
2007/0035164 A1 * 2/2007 North ..... A47C 7/70 297/217.1
2007/0228781 A1 * 10/2007 Baru ..... A47C 7/72 297/170
2007/0252050 A1 * 11/2007 Kennedy ..... G06F 3/039 248/118.3
2007/0257530 A1 * 11/2007 Florez ..... A47C 15/004 297/217.3
2007/0278834 A1 12/2007 Kielland
2008/0029663 A1 * 2/2008 Derry ..... F16M 11/10 248/178.1
2008/0150337 A1 * 6/2008 Bilak ..... A47C 7/462 297/452.33
2008/0164737 A1 * 7/2008 Fowlds ..... A47C 7/006 297/284.4
2008/0229492 A1 * 9/2008 Jamieson ..... A47C 1/0265 4/578.1
2010/0187372 A1 * 7/2010 Smirnov ..... F16M 13/02 248/118
2010/0194155 A1 * 8/2010 Dankovich ..... A47B 83/001 297/188.21
2010/0201165 A1 8/2010 Dankovich
2011/0031788 A1 * 2/2011 Kosik ..... A47C 3/0257 297/217.3
2011/0109134 A1 * 5/2011 Filipour ..... A47C 7/723 297/217.4 X
2012/0068504 A1 * 3/2012 Ting ..... F16M 13/00 297/135
2012/0146368 A1 * 6/2012 Oltesvig ..... A47C 7/72 297/188.04
2012/0223555 A1 * 9/2012 Brown, Jr. ..... A47C 7/72 297/217.4 X
2013/0134744 A1 * 5/2013 Dehli ..... A47C 7/70 297/173
2013/0214566 A1 * 8/2013 Mazur ..... A47C 7/503 297/135

(56) References Cited

U.S. PATENT DOCUMENTS

| | | | | |
|---|---|---|---|---|
| 2014/0084642 | A1 | 3/2014 | Park | |
| 2014/0225402 | A1* | 8/2014 | Dehli | A47C 7/723 297/173 |
| 2014/0306075 | A1* | 10/2014 | Stieler | A47C 7/622 248/176.3 |
| 2016/0338495 | A1* | 11/2016 | Purintun | A47C 7/70 |
| 2017/0143117 | A1 | 5/2017 | Koulizakis | |
| 2017/0319416 | A1* | 11/2017 | Bailey | A61G 15/125 |
| 2020/0139851 | A1* | 5/2020 | Oshima | B60N 2/0252 |
| 2021/0037985 | A1* | 2/2021 | Wu | A47C 20/027 |
| 2023/0189989 | A1* | 6/2023 | Ok | A47B 83/02 297/170 |

FOREIGN PATENT DOCUMENTS

| | | | | | |
|---|---|---|---|---|---|
| CN | 215993325 | U | * | 3/2022 | A47C 1/00 |
| GB | 2028117 | A | * | 3/1980 | A47B 83/02 |
| WO | WO-9922624 | A1 | * | 5/1999 | A47C 7/68 |
| WO | WO-2010147432 | A2 | * | 12/2010 | A47C 7/72 |
| WO | WO-2011016707 | A2 | * | 2/2011 | A47C 1/0355 |

* cited by examiner

WORKSTATION

FIELD OF THE INVENTION

The present disclosure relates to an ergonomic chair, more specifically, but not by way of limitation, more particularly to a workstation for preventing the development of aches and pains normally resulting from long hours at the computer.

BACKGROUND

Any discussion of the related art throughout the specification should in no way be considered as an admission that such related art is widely known or forms part of common general knowledge in the field.

Spending long hours working on a computer with the usual chair and desk setup may result in the development of aches and pains and wide range of health problems. Typically, this is the result of mechanical stress being exerted on different locations on the person's body while using the computer, including the neck, back, arms, shoulders and feet. While ergonomic chairs often provide some relief in the form of lumbar support, they tend to focus on the back region and fail to reduce mechanical stress to all sections of the person's body simultaneously, notably on the neck, shoulders and feet regions. There is a need for a workstation that can replace the usual chair and desk setup and that can prevent the development of aches and pains due to spending long hours using a computer for multiple areas of the body simultaneously.

U.S. Pub. No. 2001/0020810 A1 (Kennedy) discloses a computer work station. The computer work station is disclosed having a base, a lower support pivotally mounted to the base about a pivot joint, and a lifting mechanism for pivoting the lower support about pivot joint between a range of position extending between a declined position and an inclined position. The computer work station also includes a chair, a desk mounted to the lower support, and a computer keyboard support pivotally mounted to the desk for movement between a lifted position and an operating position. Shortcomings include a lack of a raised elongated portion on the backrest with a recessed channel therein, a lack of vibrating nodes for the neck and feet, a lack of a display mount for attaching a display in front of the user and configured to move with the backrest.

U.S. Pub. No. 2007/0278834 A1 (Kielland) discloses a workstation module for a reclinable chair. The workstation comprises a base, a working platform and a supporting member between the base and the working platform is disclosed and used in conjunction with a typical ergonomically adjustable office chair. The workstation includes a pair of leg rests adjustably fixed to the supporting member such that the user can fully extend and support their legs in a comfortable manner. The angle and position of the working platform and leg rests are adjusted in concert with adjustments to the chair's height and seating angle to optimize the user's posture while operating a computer. Shortcomings include a lack of a chair having a raised elongated portion on the backrest with a recessed channel therein, a lack of vibrating nodes for the neck and feet, and a lack of a display mount for attaching a display in front of the user and configured to move with the backrest.

U.S. Pub. No. 2010/0201165 A1 (Dankovich) discloses an ergonomic work station. The work station comprises a base. A seat and a tower are each cooperatively connected to the base thereby providing an adjustable interaction between the seat and the tower. The tower supports a keyboard support and the seat has an armrest for supporting an occupant. At least one armrest adjustment device is disposed between the seat and the armrest and is moveable between an unlocked position to allow for adjustment of the armrest relative to the seat to an ergonomically correct position relative to the keyboard support and to a locked position to lock the armrest in the ergonomically correct position. An armrest lever is operatively connected to the at least one armrest adjustment device to move the at least one armrest adjustment device between the unlocked position and the locked position. Shortcomings include a lack of a raised elongated portion on the backrest with a recessed channel therein, a lack of vibrating nodes for the neck.

U.S. Pub. No. 2014/0084642 A1 (Park) discloses a computer chair. The computer chair comprising a seat support, a leg support, a monitor mount, a rotatable keyboard and mouse support and double rotatable armrests centered on a power seat which allows sitting posture to be adjusted so as to match the body form of the user. The object of the present invention is to make computer usage environments more ergonomic than hitherto, and to provide a computer usage environment which allows the user to perform more work effectively as they feel less tired even when operating a computer for a long time. Shortcomings include a lack of a raised elongated portion on the backrest with a recessed channel therein, and a lack of vibrating nodes for the neck and feet.

U.S. Pub. No. 2017/0143117 A1 (Koulizakis) discloses a portable work support and keyboard/mouse tray and work station and tethered chair. The portable work support device and support for a key board and a pointing device, such as a mouse, for use by occupants of reclining capable office chairs having an adjustable fitted footrest assembly connected to the chair that will provide the seated chair user the ability to achieve a desired pelvis/feet triangulation stabilization effect while reclined by having the seated user's feet placed correctly in an attached footrest thereby producing a tactile input or cue that will lead to the desired muscle or motor output, causing the seated user to actually sit all the way back in the chair, and to be in a posture biomechanically neutral for using and working on the portable work support device, a work station removably housing the portable work support device, and a foot rest assembly to which a chair can be tethered so that a computer user can be properly positioned in a reclining position in the chair and have reduced posture issues when using the work support device while using computer or like equipment. Shortcomings include a lack of a raised elongated portion on the backrest with a recessed channel therein, a lack of vibrating nodes for the neck and feet, a lack of a display mount for attaching a display in front of the user and configured to move with the backrest.

U.S. Pat. No. 4,915,450 A (Cooper) discloses work station system. The work station system comprises a frame substructure for holding aloft a horizontal axial shaft. A chair is coupled to the shaft by chair coupling member; a device carriage is coupled to the shaft by a carriage coupling member; and a footrest assembly is coupled to the shaft by a footrest coupling member. The chair, device carriage, and footrest assembly are coupled to the shaft to selectively pivot together about the shaft, and in such a manner that a constant spatial relationship is maintained between the chair and the device carriage. The chair is swivelly connected to the chair coupling member. The frame substructure is situated substantially entirely on one side of a perpendicular bisector dropped from the shaft to a base. The frame substructure includes axis elevating means for elevating the shaft. The axis elevating means carries a support surface which is accessible by a human operator. Shortcomings include a lack of a raised elongated portion on the backrest with a recessed channel therein, a lack of vibrating nodes for the neck and feet, a lack of a display mount for attaching a display in front of the user and configured to move with the backrest.

U.S. Pat. No. 8,087,724 B2 (Kosik et al.) discloses an ergonomic computer chair that relates to chairs for special purposes, and more particularly, to computer operator's chair which is ergonomically designed to prevention of orthopedic and cardiovascular diseases and creation of psychophysical comfort, especially as regards reduction of fatigability during long-lasting work with computer. The ergonomic computer chair includes a seat with a backrest and a pedestal with a support frame made in the circular arc form, a support ring installed on the support frame wherein said support ring can rotate around its axis. The backrest is made of a rigid part and an elastic part separated from one other by at least three elastic bladders connected to a compressor by air tubes having electric valves. The rigid part of the backrest is hinged to the seat, and the seat is hinged to a seat inclination drive and to a footrest. A mounting of the computer monitor and keyboard is made by means of a movable sector which is made as an arched pipe with centering bearings. The chair has electric drives to move the support ring along the support frame of the pedestal, to move the movable sector along the support ring, to move the monitor longitudinally and to control monitor's inclination. This makes it possible to change the user's body position within the space against the Earth's gravitational field vector during the entire time of the work with computer. The use of the proposed device reduces the probability of orthopedic diseases occurrence, creates comfort and increases efficiency of the computer user. Shortcomings include a lack of a raised elongated portion on the backrest with a recessed channel therein, and a lack of vibrating nodes for the neck and feet.

U.S. Pat. No. 9,220,348 B2 (Stieler et al.) discloses an apparatus and method for ergonomic support of human system interaction. The human interaction support apparatus for supporting a peripheral comprises means for defining a user area into which a user may be received and means for hanging a first peripheral from the means for hanging such that the first peripheral is in front of the user area. Shortcomings include a lack of a raised elongated portion on the backrest with a recessed channel therein, and a lack of vibrating nodes for the neck and feet.

U.S. Pat. No. 9,433,288 B2 (Voigt et al.) discloses an ergonomic productivity workstation having coordinated and harmonized movement of head rest, backrest, seat, leg rest, arm rests, monitor support, and work trays through sitting, standing, and reclining configurations. The ergonomic workstation includes a base; an effective hip axis affixed to the base; a seat bottom that rotates about the effective hip axis; a seat back that rotates about the effective hip axis; an effective shoulder axis positionally fixed to the seat back; an effective elbow axis positionally fixed to the seat back; a monitor support having a monitor mount that rotates about the shoulder axis; and an input device tray support configured such that an input device tray on the support rotates about the elbow axis. As the workstation moves through a broad range of operational zones, it maintains a fixed eye-to-monitor distance and fixed angle between the user's head and the monitor throughout a significant portion of the range of motion, and a fixed distance from the user's elbow to an input device throughout the entire range of motion. Shortcomings include a lack of a raised elongated portion on the backrest with a recessed channel therein, and a lack of vibrating nodes for the neck and feet.

U.S. Pat. No. 10,512,331 B2 (Zhang) discloses an ergonomic smart chair and mobility system and use thereof. The system can be used as a working station, a working chair, a mobility device, a personal care device, or a combination thereof. The system is designed to provide ergonomic seating posture for a person who is seated on the chair. The system is also designed to reduce body stress by providing automatic movements of parts of the chair at predefined time points. Shortcomings include a lack of a raised elongated portion on the backrest with a recessed channel therein, and a lack of vibrating nodes for the neck.

BRIEF SUMMARY

It is an object of the invention to provide a workstation that replaces the typical office chair and desk setup and is aimed reducing the mechanical stress and at preventing outright the development of aches and pains normally resulting from long hours at a computer or similar devices, in accordance with different embodiments.

In accordance with one aspect, there is provided a workstation comprising: a base; a seat coupled to said base; a backrest angularly coupled to said seat at a designated recline angle for receiving the user's back thereon, the backrest comprising a raised spine rest portion, centered laterally in the middle of said backrest, and extending longitudinally along a designated length of said backrest so as to have the arms and shoulders of the user offset posteriorly via the effect of gravity; a neck rest coupled to the upper end of said backrest comprising one of more vibrating nodes thereon configured to engage with the back of the user's neck; a headrest coupled to the upper end of the neck rest for receiving the back of the user's head thereon; a footrest adjustably tilted and coupled to said base, the footrest having two vibrating nodes thereon, each vibrating node positioned for receiving the ball of a foot of the user thereon; a display mount rigidly coupled to the back of the backrest at a first end and having a second end located and configured to removably affix one or more displays thereto so that the one or more displays are positioned in front of the face of the user substantially parallel to the coronal plane of the user's head, irrespective of the designated recline angle; at least one platform for receiving an input device thereon; wherein each of the mouse platform or keyboard mount is coupled to a side of said seat and positioned so that the elbow of the user rests on the backrest while using the mouse or keyboard.

In one embodiment, the at least one platform comprises a keyboard mount for receiving a keyboard thereon.

In one embodiment, said keyboard mount is adjustably coupled to said seat via a plurality of articulated support arms that is configured to allow the keyboard mount to be moved along six degrees of freedom.

In one embodiment, the at least one platform further comprises a mouse platform for receiving a computer mouse thereon.

In one embodiment, said mouse platform comprises an armrest portion for receiving the user's upper arm thereon.

In one embodiment, at least one of the mouse platform and the keyboard mount is adjustably coupled to said seat.

In one embodiment, said mouse platform and said keyboard mount are each configured to be removably affixable to either a left side or a right side of said seat.

In one embodiment, said designated recline angle is between 60 and 80 degrees.

In one embodiment, said backrest is hingedly coupled to the seat and wherein said designated recline angle is adjustable.

In one embodiment, the designated recline angle is not adjustable by more than 20 degrees.

In one embodiment, said spine rest portion further comprises a recessed channel therein extending longitudinally along the middle thereof to receive one or more spinous processes of the user therein.

In one embodiment, the backrest further comprises a raised lumbar support portion near a lower end of the backrest for supporting the user's lower back.

In one embodiment, the lower end of the raised elongated portion is adjacent to said seat, and wherein each lateral side of the backrest adjacent to said seat further comprises a raised side portion thereon.

In one embodiment, the headrest, neck rest and elongated raised portion are rigidly coupled and configured to be slidingly adjustable to the backrest so as to be raised or lowered with respect thereto.

In one embodiment, the footrest is tilted towards the seat to receive the entirety of the user's feet thereon so that the user's ankles are in a neutral position.

In one embodiment, the footrest is slidingly adjustable to the base.

In one embodiment, the footrest is removable.

In one embodiment, the workstation further comprises a control module communicatively coupled to at least some of the vibrating nodes of the neck rest and footrest, and operable to control a vibration frequency or intensity of said at least some of the vibrating nodes.

In one embodiment, the workstation further comprises a tray, the tray surface being substantially horizontal, and the tray being coupled to a side of said seat.

In one embodiment, said tray is hingedly coupled to the side of said seat and configured to be folded between a horizontal configuration and a reclined configuration.

BRIEF DESCRIPTION OF THE DRAWINGS

To easily identify the discussion of any particular element or act, the most significant digit or digits in a reference number refer to the figure number in which that element is first introduced.

In the FIGURES, embodiments are illustrated by way of example. It is to be expressly understood that the description and FIGURES are only for the purpose of illustration and as an aid to understanding.

Figure 1:
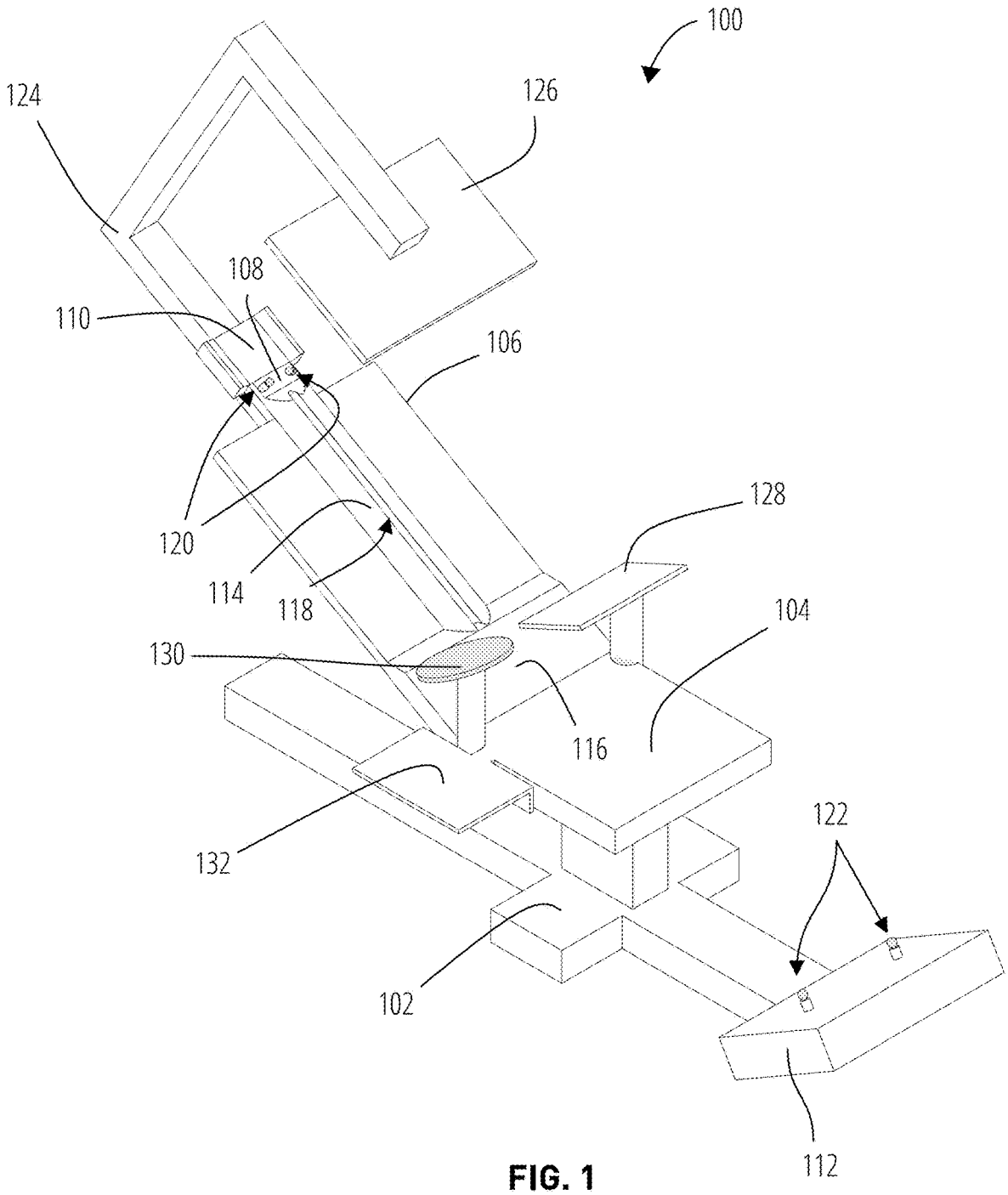

Embodiments will now be described, by way of example only, with reference to the attached FIGURES, wherein the FIGURES:

FIG. 1 illustrates a perspective view of a workstation, in accordance with one embodiment.

Figure 2A:
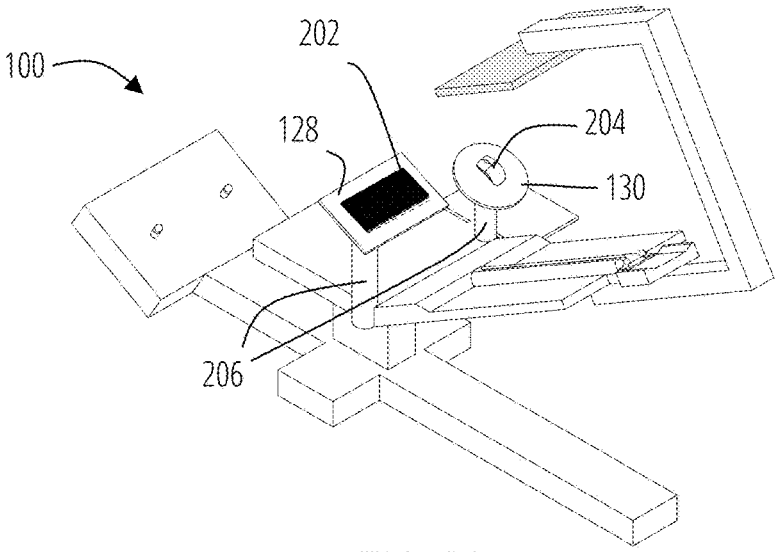
Figure 2B:
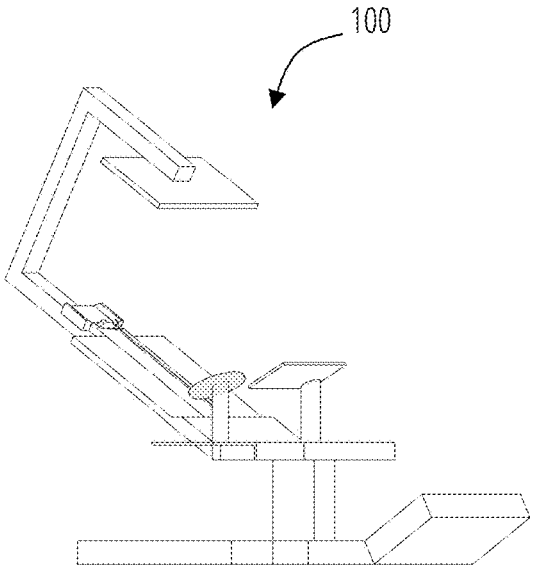

FIGS. 2A and 2B illustrate additional perspective views (FIGS. 2A and 2B) and a side view (FIG. 2C) of the workstation, in accordance with one embodiment.

Figure 3A:
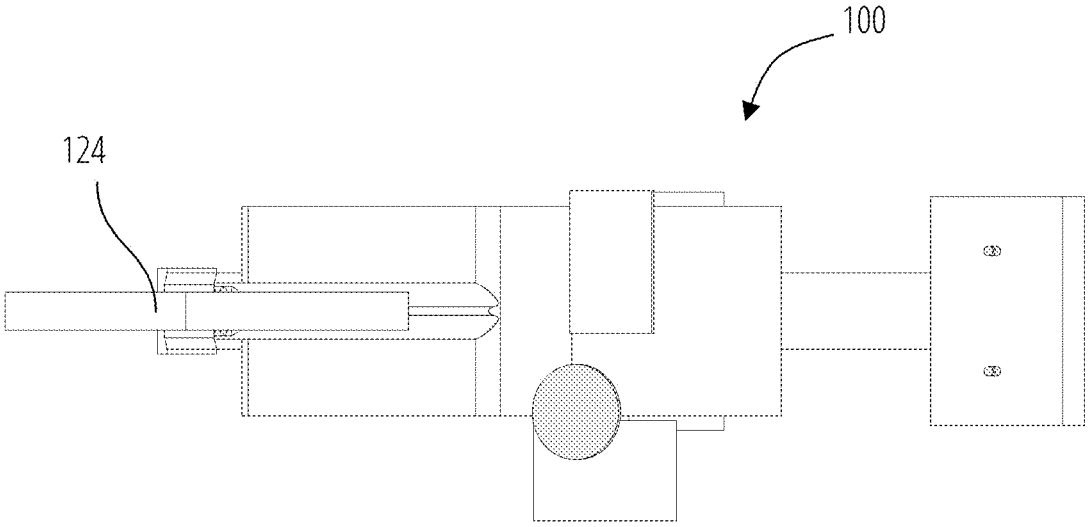
Figure 3B:
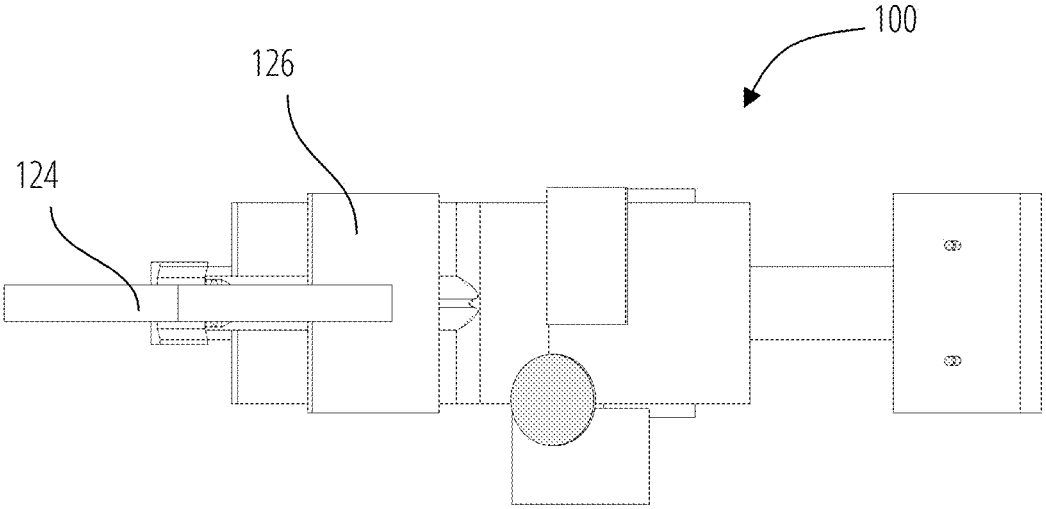

FIGS. 3A and 3B illustrate top views of the workstation with (FIG. 3A) and without (FIG. 3B) the display attached to the display mount, in accordance with one embodiment.

Figure 4:
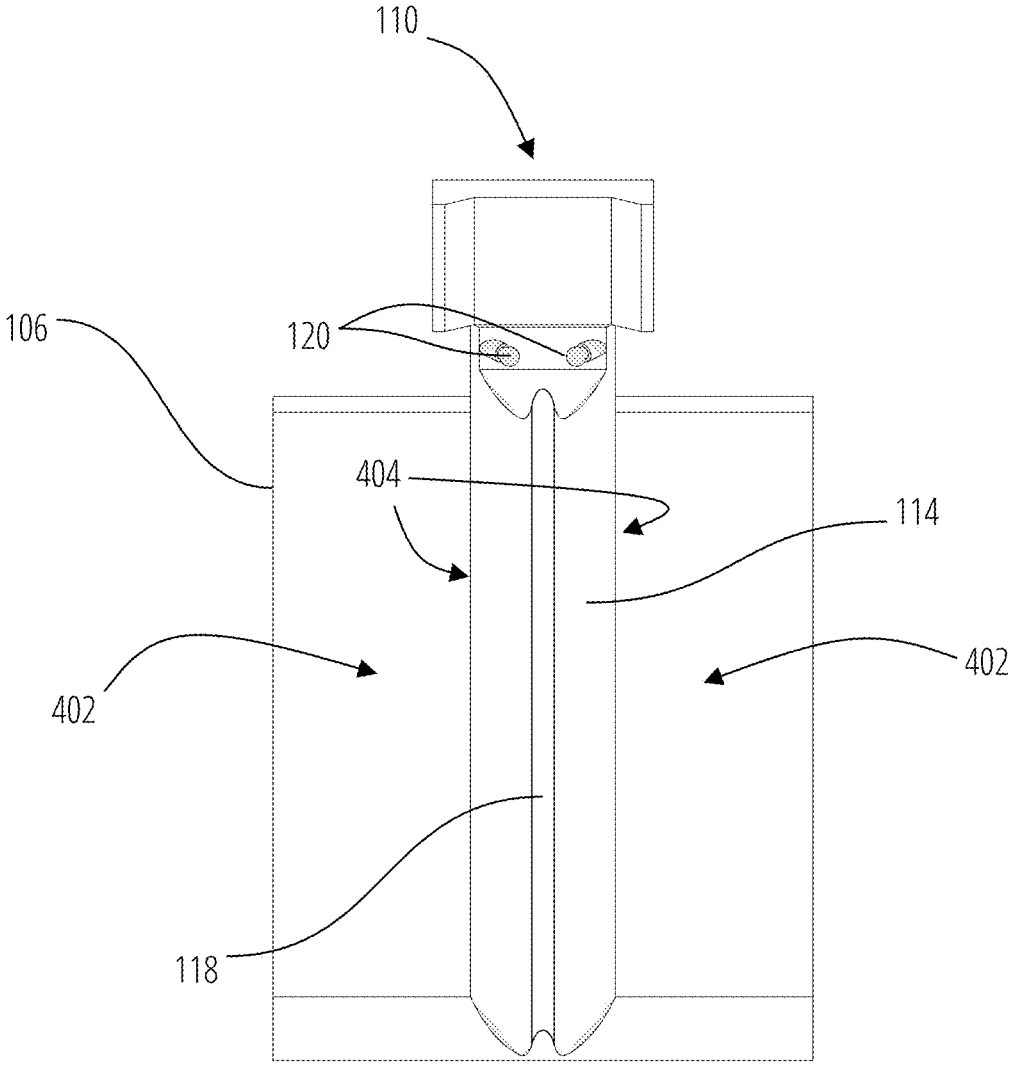

FIG. 4 illustrates a front view of the backrest, neck rest and headrest of the workstation, in accordance with one embodiment.

Figure 5A:
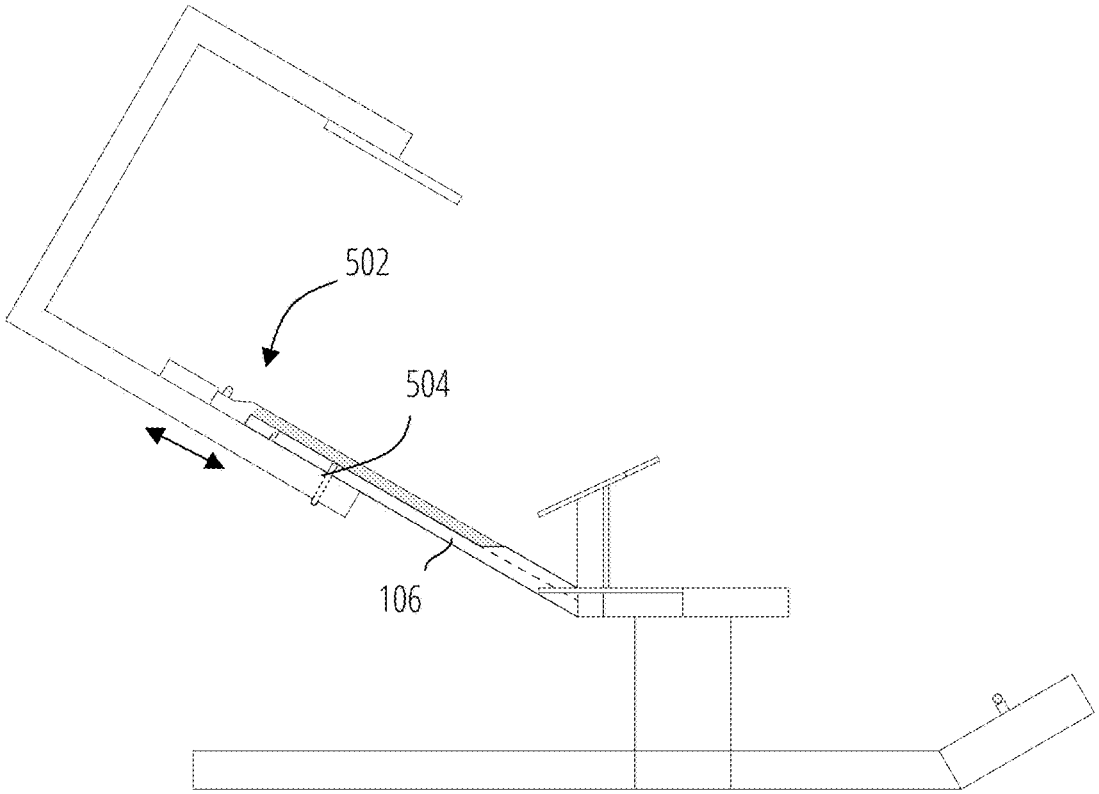
Figure 5B:
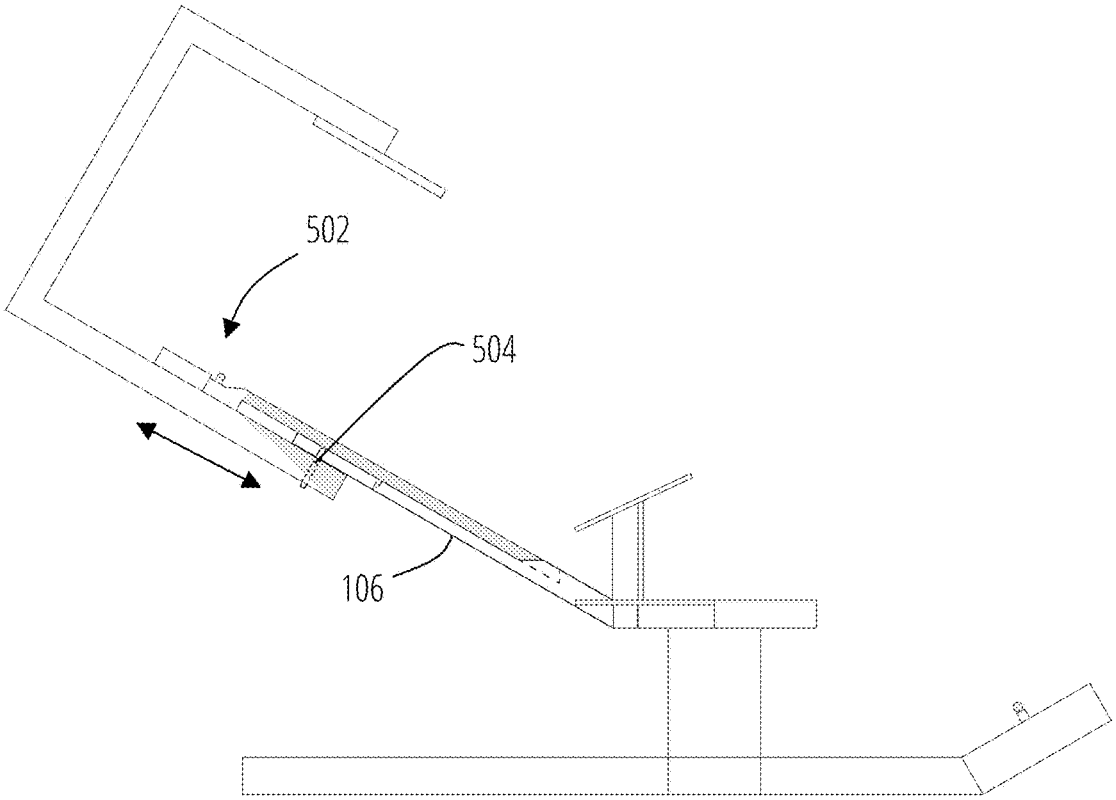

FIGS. 5A and 5B illustrate a side view of the raised elongated portion, neck rest, headrest, and display mount configured as a single movable piece that can slidingly move over the backrest between a fully inserted configuration (FIG. 5A) and an extended out configuration (FIG. 5B), in accordance with one embodiment.

Figure 6A:
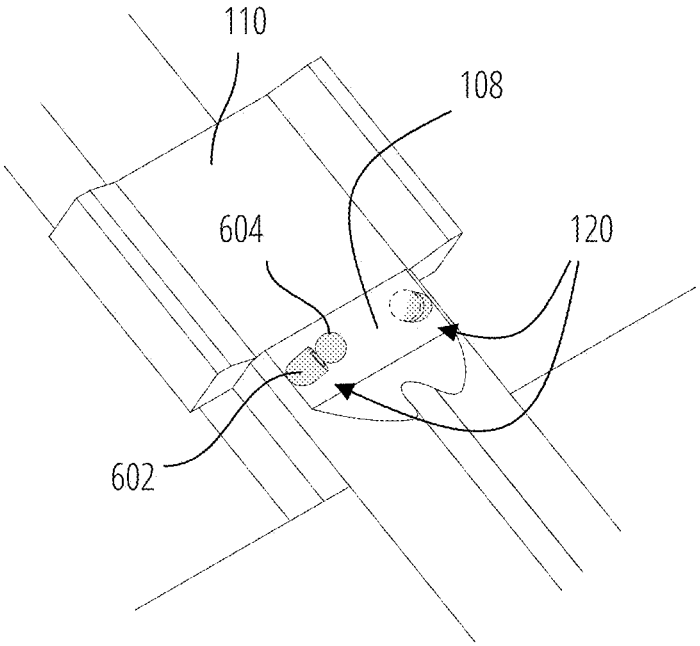
Figure 6B:
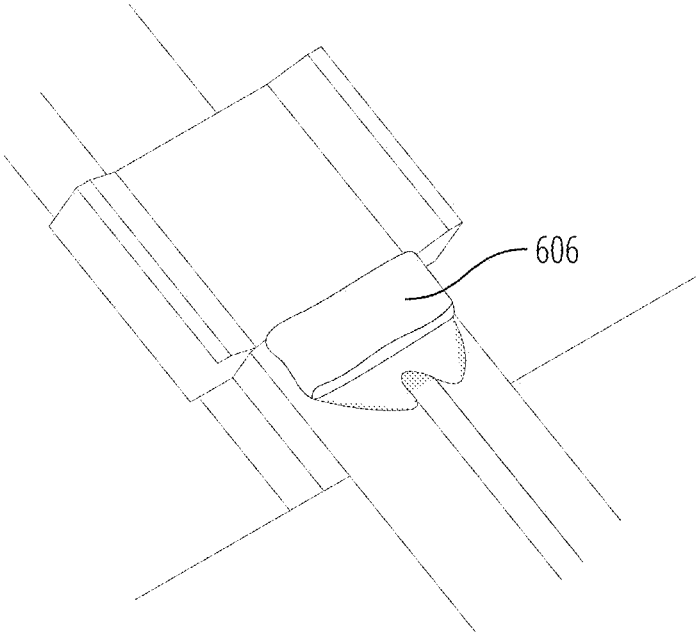

FIGS. 6A and 6B illustrate perspective views of the neck rest and headrest of the workstation, without (FIG. 6A) or with (FIG. 6B) a neck pillow resting on the vibrating nodes, in accordance with one embodiment.

Figure 7A:
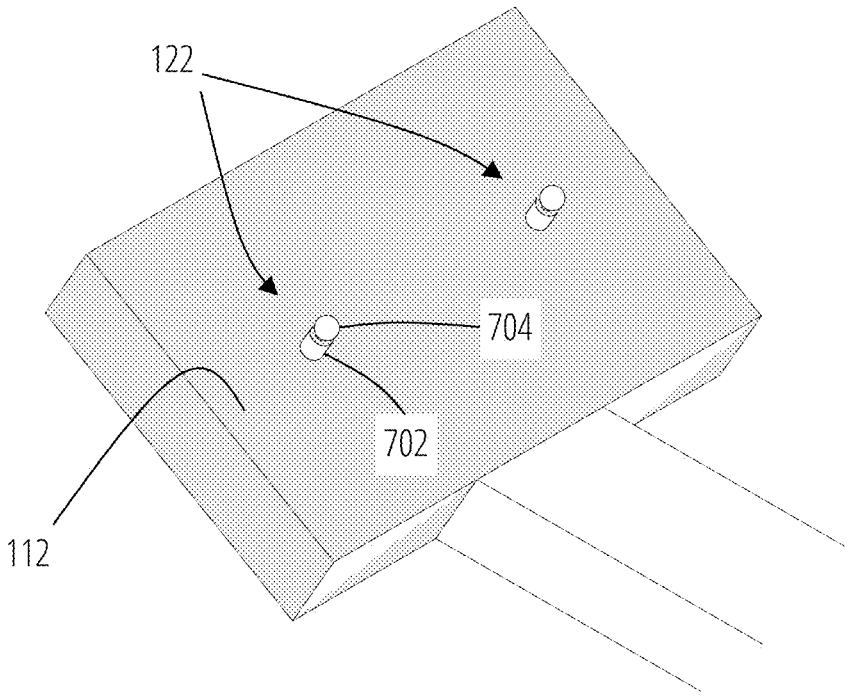
Figure 7B:
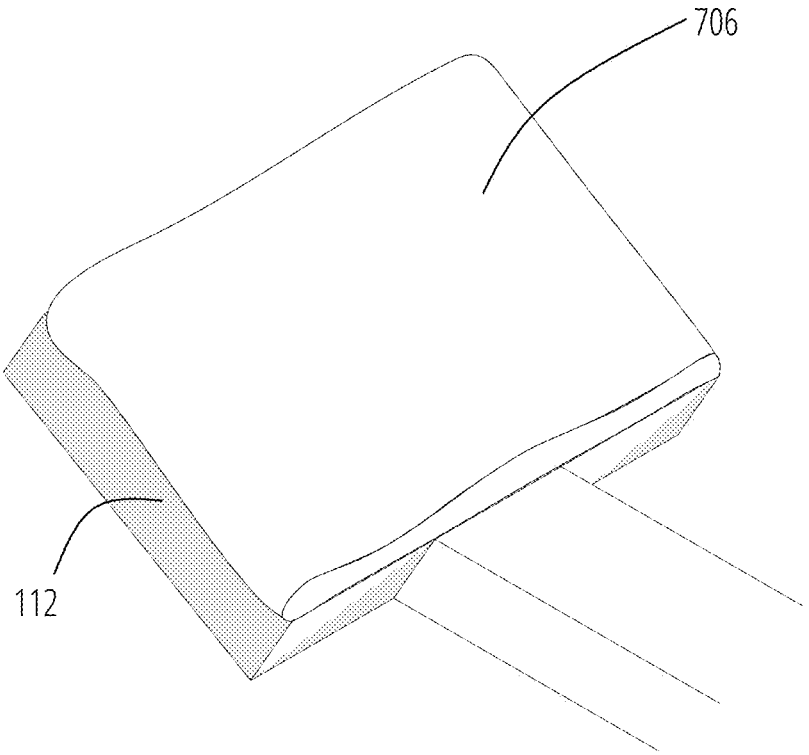

FIGS. 7A and 7B illustrate perspective views of the footrest of the workstation, without (FIG. 7A) or with (FIG. 7B) a foot pillow resting on the vibrating nodes, in accordance with one embodiment.

Figure 8A:
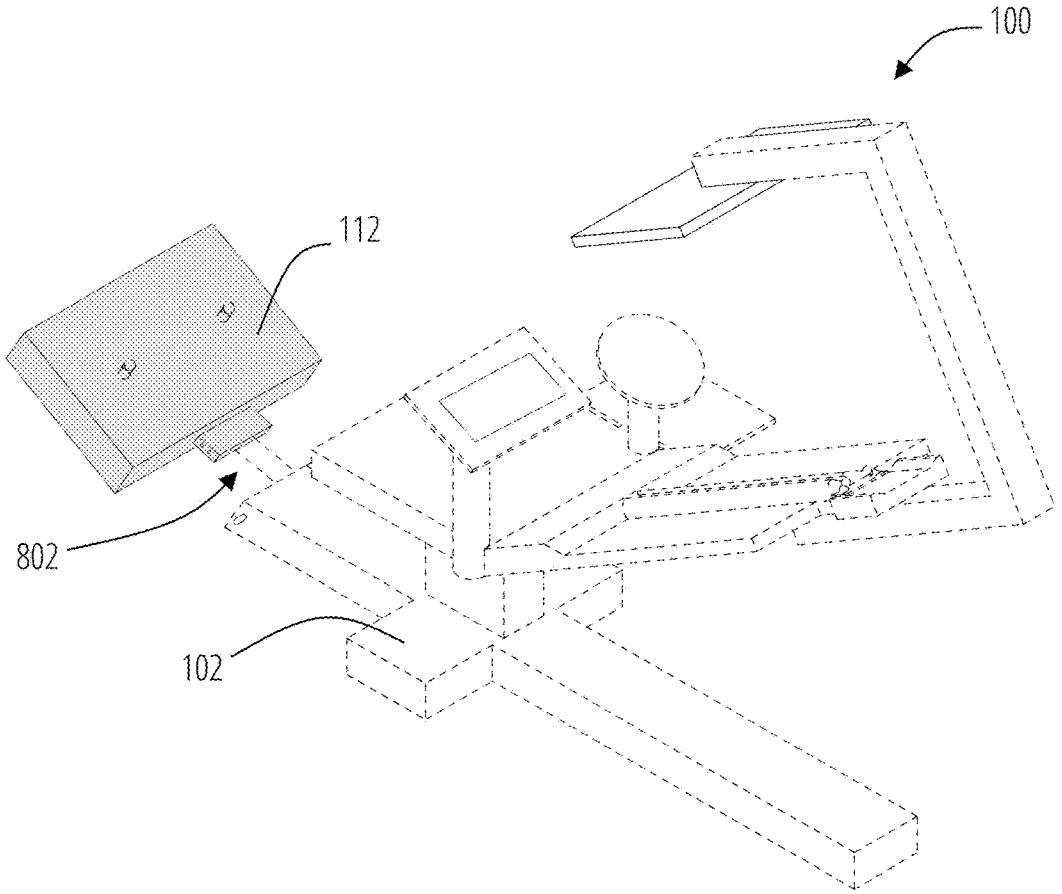
Figure 8B:
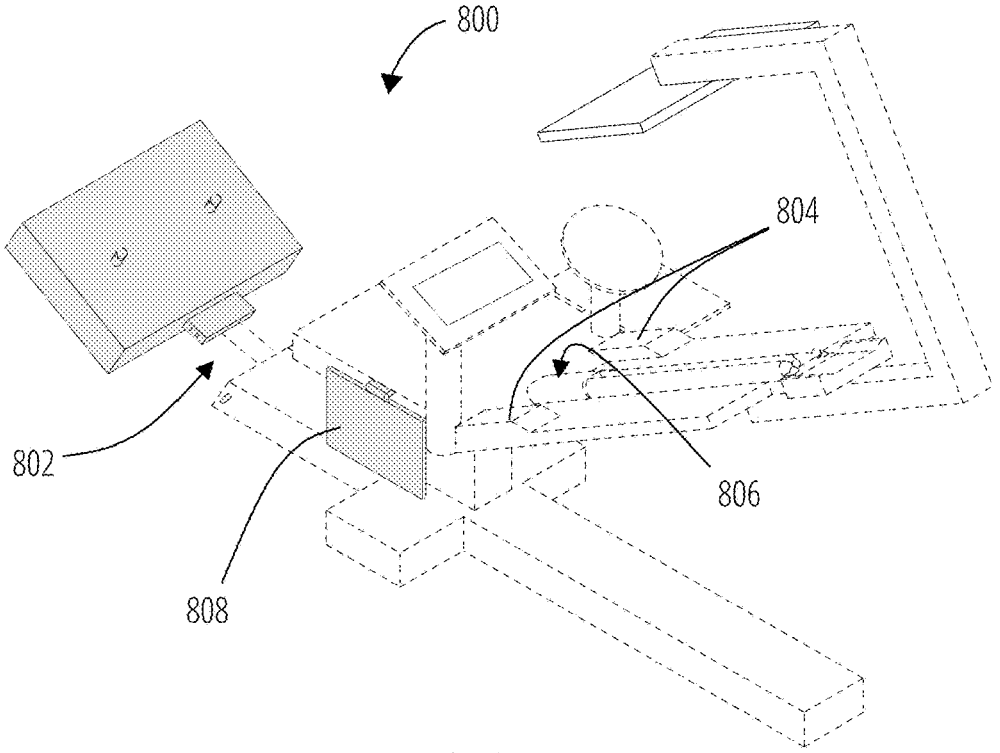

FIGS. 8A and 8B illustrates perspective views of the workstation comprising an adjustable footrest, with one embodiment (FIG. 8A) comprising the lumbar support portion and the other (FIG. 8B) having an extended raised elongated portion instead, in accordance with one embodiment.

Figure 9A:
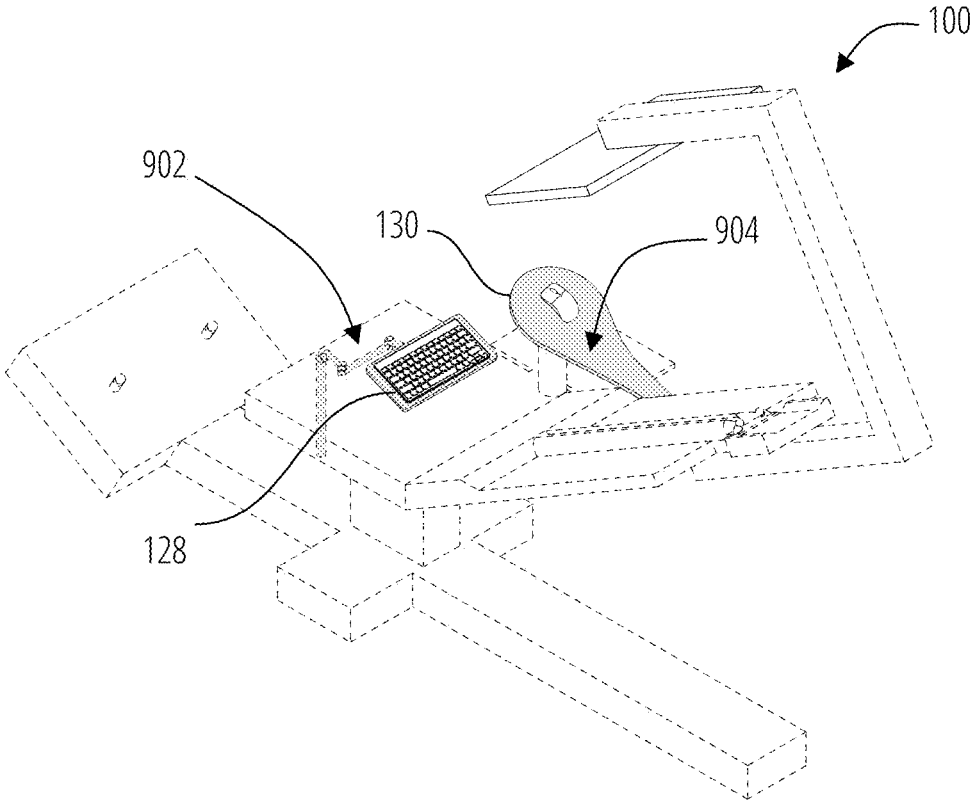
Figure 9B:
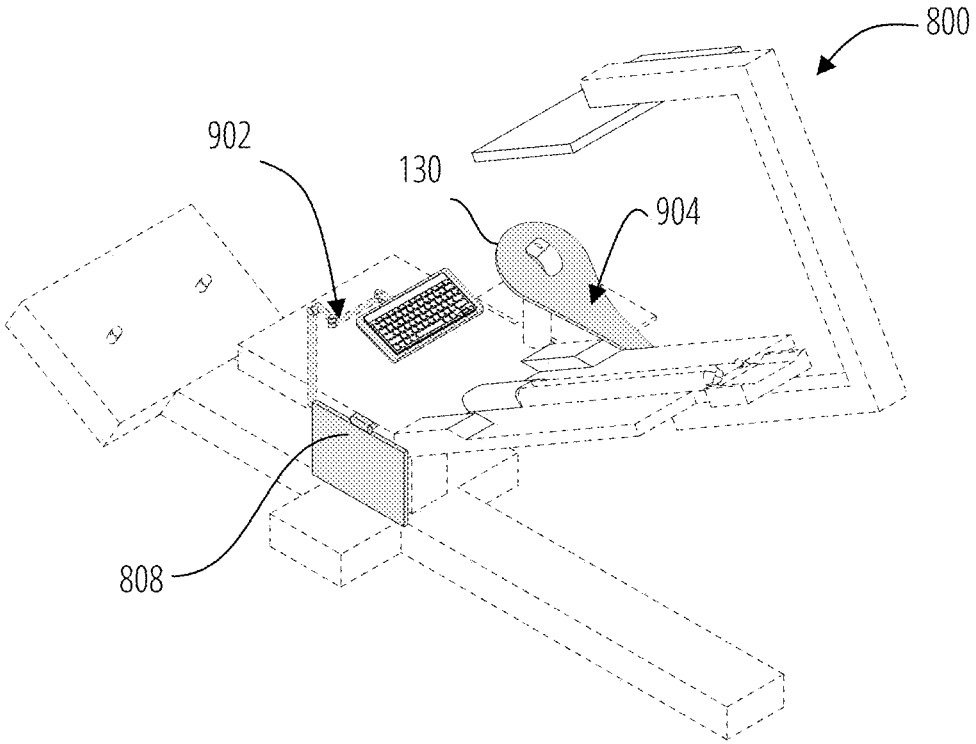

FIGS. 9A and 9B illustrates perspective views of the workstation both showing the keyboard mount comprising (support arms) and the mouse platform comprising an armrest, with one embodiment (FIG. 9A) having the lumbar support portion and the other (FIG. 9B) having an extended raised elongated portion instead, in accordance with one embodiment.

Figure 10:
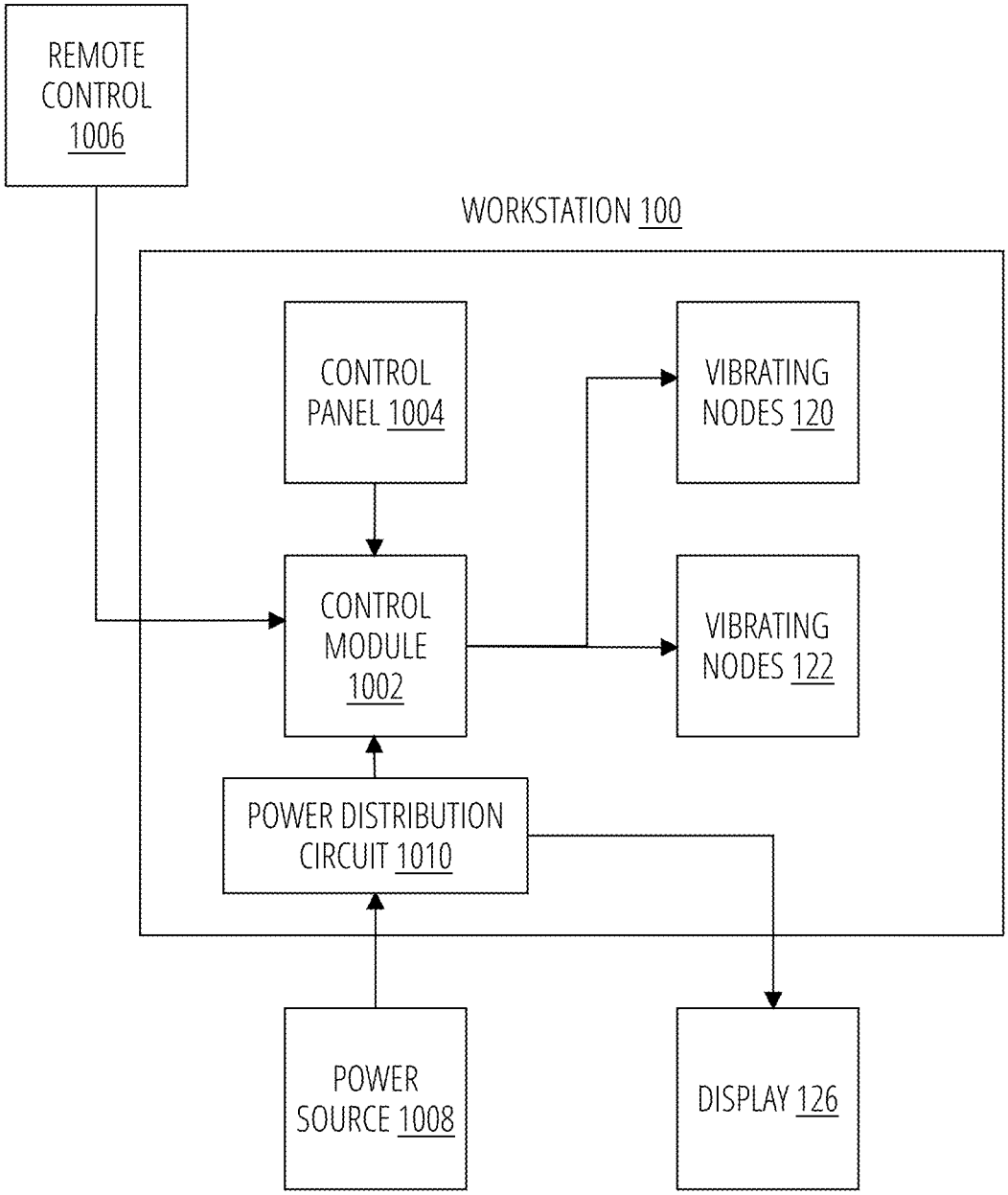

FIG. 10 is a block diagram illustrating a control module of the workstation, in accordance with one embodiment.

DETAILED DESCRIPTION

The details of one or more embodiments of the subject matter of this specification are set forth in the accompanying drawings and the description below. Other features, aspects, and advantages of the subject matter will become apparent from the description, the drawings, and the claims.

Like reference numbers and designations in the various drawings indicate like elements.

The workstation described herein, in accordance with various embodiments, replaces the typical office chair and desk setup and is aimed reducing the mechanical stress and at preventing outright the development of aches and pains normally resulting from long hours at a computer or similar devices. In some embodiments, the workstation is used for interacting with a computer for a prolonged period of time, either for work purposes (e.g., typing, manipulating a mouse, etc.) or any other activity that requires the use of a display or monitor. These may include, for example and without limitation, watching a movie/TV show, and/or playing videogames or the like.

In some embodiments, the workstation is specially configured to allow people to use input devices such as keyboard and mouse inputs close to their body, reducing neck and shoulder tension immensely by allowing best retraction of the shoulders. Also, it provides stimulation and engagement to the underside of the foot, improving the metatarsal compression, collapsed transverse arch, and impaired circulation that results from wearing shoes and eventually contributes to plantar fasciitis. Lastly, it provides similar stimulation to the neck to reduce muscle tension that contributes to headaches and neck pains.

FIG. 1 shows a workstation 100 comprising a base 102 supporting a seat 104 for a user to sit thereon. The workstation 100 further is shown comprising a backrest 106, a neck rest 108, a headrest 110 and footrest 112 for receiving the back, neck, head and feet of the user thereon, respectively. In some embodiments, the backrest 106 is angularly coupled to the seat 104 at a designated recline angle (shown for example in FIG. 2C), with the neck rest 108 and headrest 110 being coupled to an upper edge or near an upper edge of the backrest 106, and being substantially parallel thereto.

In some embodiments, the width of the backrest 106 is large enough to comfortably accommodate the full width of user's back, shoulders and upper arms thereon. In some embodiments, the workstation 100 further comprises a raised elongated portion 114 centered on the backrest 106 and extending longitudinally along a designated length thereof. The raised elongated portion 114 is configured to comfortably engage with the middle of the user's back along the spine. The difference in height between the raised elongated portion 114 and the lateral sides of the backrest 106 has the effect of pulling the shoulders and upper arms of the user slightly backwards (towards the floor) via the effect of gravity due to the tilt of the backrest 106. Thus, the user's shoulders and upper arms rest slightly posteriorly on the lower surface of the lateral sides of the backrest 106. Additionally, in some embodiments, the backrest 106 may further comprise a lumbar support portion 116 near the lower end and encompassing the full width thereof, which in combination with the reclining helps prevent serious lower back compression.

In some embodiments, the backrest 106 may be hingedly coupled to the seat 104 and the designated recline angle may be adjustable.

In some embodiments, for added comfort and to avoid excessive pressure on the spinous processes due to presence of the raised elongated portion 114, the raised elongated portion 114 may further comprise in its center a recessed channel 118 extending longitudinally alongside it and configured to receive the user's spinous processes therein. While illustrated in FIG. 1 as a single channel of fixed depth and size, the recessed channel 118 may in some embodiments have a varying depth and size or, in some embodiments, take the form of a plurality of aligned circular recesses shaped and sized so as to individually receive a spinous process therein.

In some embodiments, the neck rest 108 comprises two small vibrating nodes 120 protruding therefrom, which are angularly positioned so as to make contact with each side of the back of the user's neck and configured to apply vibrations thereto.

In some embodiments, the headrest 110 may comprise a substantially flat surface for receiving the back of the user's head, with slightly elevated tapered edges on the lateral sides thereof to keep the head from rotating to the left or to the right. Other shapes and/or the use of a detachable pillow (not shown) may also be used, without limitation.

In some embodiments, the footrest 112 may be angularly coupled to the base 102. The footrest 112 will generally be tilted towards the seat 104 so that the entirety of the user's feet may rest thereon comfortably and to ensure that the ankle can remain in as a neutral and regular position as possible. In some embodiments, the footrest 112 may be configured so that the user can adjust either the orientation and/or the height of the footrest 112 with respect to the floor level. In addition, in some embodiments, the footrest 112 may further comprise two vibrating nodes 122 thereon, each node positioned on the footrest 112 to receive the ball of a foot of the user thereon and apply vibrations thereto.

In some embodiments, the workstation 100 further comprises a display mount 124 coupled at one end to the back of the backrest 106 (or other portions/elements of the workstation 100) and that is configured to bend/curve/arc behind and above the headrest 110 so that the second end, which may be configured to releasably affix one or more displays thereto (display 126 in FIG. 1), allows the display 126 to be in front of the user's face at an angle substantially parallel to the coronal plane of the user's head irrespective of the designated recline angle of the backrest 106. In some embodiments, the display mount 124 may further comprise a hollow interior to pass therethrough the display's cables. In other embodiments, clips or other fastening means may be provided to releasably affix the cables on the exterior of the display mount 124. In some embodiments, the display mount 124 may take the form of a single rigid piece (for example as shown in FIG. 1), or it may comprise a plurality of sections or portions that are hingedly or adjustably coupled to each other.

In some embodiments, the workstation 100 comprises at least one platform for receiving an input device thereon. For example, in some embodiments, a keyboard mount 128 and/or a mouse platform 130. As illustrated in FIG. 1, the keyboard mount 128 and mouse platform 130 are positioned to be substantially close to the backrest 106 so as to be easily accessible to the user's hands without effort or strain to their body, thus reducing neck and shoulder tension by allowing best retraction of the shoulders. For example, they can be positioned so that the user's elbow always rests on a lateral portion of the backrest 106 while using the mouse or keyboard. In some embodiments, the keyboard mount 128 may be configured to receive other types of input devices thereon, such as videogame controllers or tablets, or any other input devices known in the art.

In some embodiments, as shown in FIG. 1, the workstation 100 may further comprise a tray 132 attached to a side of the seat 104 (herein illustrated on the right side of the seat 104 as an example only). Additionally or alternatively, a second tray may also be located on the other side of the workstation 100.

Figure 2C:
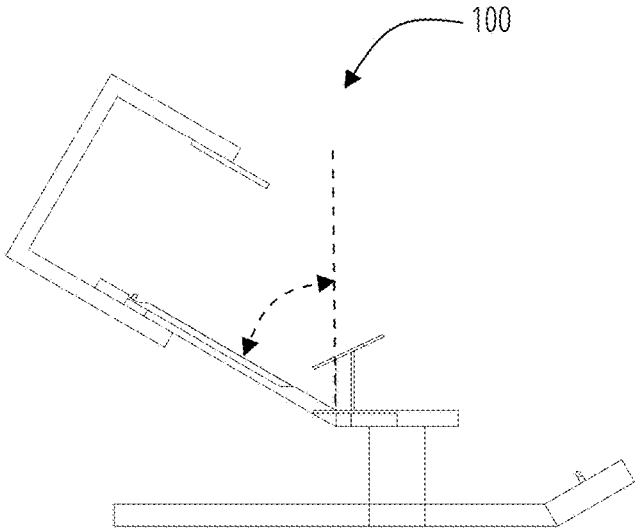

FIGS. 2A, 2B and 2C show additional perspective views of the workstation 100. Notably, FIG. 2A shows the keyboard mount 128 having a keyboard 202 resting thereon and a computer mouse 204 on the mouse platform 130. In some embodiments, the mouse platform 130 comprises a flat and smooth surface that can be used to move the computer mouse 204 thereon. In some embodiments, the keyboard mount 128 may comprise thereon fastening means to releasably fasten the keyboard 202 thereto. Different fastening means may be used, for example clips or the like. In some embodiments, the receiving surface of the keyboard mount 128 may comprise a raised portion or blocking element thereon configured to rest again the keyboard 202 (not shown) to stop the keyboard 202 from sliding down the keyboard mount 128 when the keyboard mount 128 is tilted. In some embodiments, the keyboard mount 128 may have a non-smooth or rubbery upper surface designed to increase friction between the bottom of the keyboard 202 and the keyboard mount 128, so as to reduce the risk of having the keyboard slipping.

In some embodiments, the keyboard mount 128 and the mouse platform 130 are both coupled to support member 206 affixed to the sides of the workstation 100, for example to the seat 104 and/or near the bottom of the backrest 106. In some embodiments, the keyboard mount 128 and mouse platform 130 may be detachable and interchangeable so that they can each be removably affixed either to the right support member 206 or the left support member 206, depending on the user's preference (e.g., left-handed or right-handed). In some embodiments, the height of each of the support members 206 may be adjustable. In some embodiments, the keyboard mount 128 and the mouse platform 130 may be rotatably coupled to the support members 206 so as to be tilted and/or rotated to provide a more comfortable orientation.

FIG. 2C shows a side view of the workstation 100, and further illustrates the designated recline angle of the backrest 106, neck rest 108 and headrest 110 with respect to the seat 104 via the dashed line and arrow. In some embodiments, the backrest 106 is adjust able about the user's sagittal plane. In some embodiments, the designated recline angle may be between 60 to 80 degrees and may not be changeable by the user by more than 20 degrees.

FIGS. 3A and 3B show top views of the workstation 100, both without (FIG. 3A) and with (FIG. 3B) the display 126 affixed to the display mount 124.

FIG. 4 shows a front view of the upper portion of the backrest 106, the neck rest 108 and the headrest 110, in accordance with one embodiment. FIG. 4 clearly shows the raised elongated portion 114 having on each side the lateral portions 402 of the backrest 106. In some embodiments, the raised elongated portion 114 may be substantially rounded or tapered so that its height increases gently starting from the sides 404 adjacent to the lateral portions 402 of the backrest 106 to near the middle portion comprising the recessed channel 118. However, different shapes may be used, without restriction.

In some embodiments, the raised elongated portion 114 may have a width of about 6 inches and a raised height with respect to the sides of the backrest 106 of about 2.5 inches.

FIGS. 5A and 5B show side views of the workstation 100, where in accordance with one exemplary embodiment, the raised elongated portion 114, neck rest 108, headrest 110 and display mount 124 are rigidly coupled to each other as a single movable piece 502. Thus, all of these elements may be raised or lowered simultaneously with respect to the backrest 106 by slidingly moving the single piece 502 in the axis shown by the arrows.

The length of the arrows in FIGS. 5A and 5B shows the distance between the headrest 110 and the topmost edge of the backrest 106 in the fully inserted configuration (FIG. 5A) and an extended out configuration (FIG. 5B). In some embodiments, one or more locking mechanism 504 may be used to reversibly affix the single piece 502 at a given height with respect to the backrest 106.

FIGS. 6A and 6B show a perspective view of the headrest 110 and neck rest 108, in accordance with one embodiment. As shown in FIG. 6A, as an example only, in some embodiments each vibrating node 120 may comprise an adjustable support element 602 having a vibrating element affixed thereto, for example a bearing ball 604 or the like. The vibrating nodes 120 is configured to gently engage with the user's skin on the neck region and vibrate at a designated frequency and intensity. The support element 602 may take a form of an elongated support member, configured so that its orientation may be adjusted by the user so that the bearing balls 604 are properly positioned on the user's neck. As illustrated in FIG. 6A, typically the support elements 602 will be oriented inwardly towards the center of the neck rest 108 so that the bearing balls 604 gently engage each side of the user's spine. In some embodiments, the support element 602 may be configured to house a motor, or any other means of generating vibrations known in the art, that is coupled to the bearing ball 604 and that is used to generate the vibrations thereof.

In some embodiments, as shown in FIG. 6B, a neck pillow 606 may be provided to cover the vibrating nodes 120 for additional comfort. The skilled person in the art will appreciate that different sizes and/or shapes and/or materials may be used for the neck pillow 606.

FIGS. 7A and 7B show perspective views of the footrest 112, in accordance with one embodiment. In some embodiments, each vibrating nodes 122 may comprise an adjustable support element 702 having a vibrating element affixed thereto, for example a bearing ball 704 or the like, that is configured to engage with the ball of the foot of the user and vibrate at a designated frequency and intensity. The support element 702 may take a form of an elongated support member, configured so that its orientation may be adjusted by the user so that the bearing balls 704 are properly positioned on the user's neck. As illustrated in FIG. 7A, typically the support elements 702 will be oriented and positioned so as to receive thereon the ball of the foot of the user. In some embodiments, the support element 702 may be configured to house a motor, or any other means of generating vibrations known in the art, that is coupled to the bearing ball 704 and that is used to generate the vibrations thereof.

In some embodiments, as shown in FIG. 7B, a foot pillow 706 may be provided to cover the vibrating nodes 122 for additional comfort. Different shapes, sizes and/or materials for the foot pillow 706 may be used, without restrictions.

FIGS. 8A and 8B illustrate two different embodiments wherein an adjustable coupling member 802 is used to adjust the position of the footrest 112. In some embodiments, the footrest 112 may be configured to slidingly engage with the coupling member 802 and be removably affixed thereto at a designated position. In some embodiments, the footrest 112 may be detachable.

In addition, the exemplary embodiment of FIG. 8B, herein referred to using the numeral 800, has additional distinctive features, such as the raised elongated portion 114 extending all the way down to the edge of the seat 104, with the lumbar support portion 116 being replaced with two raised side portions 804 and the bottom portion 806 of the raised elongated portion 114 extending all the way down to the seat 104. Also shown in FIG. 8B is a collapsible tray 808 that is hingedly connected to the seat 104 and configured to be folded or rotated downwards if not needed. In some embodiments, the collapsible tray 808 may be used additionally to, or in replacement of, the tray 132. In some embodiments, the collapsible tray 808 may be located on either side, or both sides, of the workstation 100.

FIGS. 9A and 9B illustrate two different embodiments of the workstation 100 and 800, respectively, comprising a plurality of hingedly coupled articulated support arms 902 for the keyboard mount 128 and the mouse platform 130 comprising an armrest portion 904 for the upper arm of the user to rest thereon. In some embodiments, the keyboard mount 128 may also comprise an armrest portion (not shown).

In some embodiments, the articulated support arms 902 comprise a plurality of elongated members hingedly connected to each other in a way that allows the keyboard mount 128 to be moved over 6 degrees of freedom (translationally and rotationally). In some embodiments, the articulated support arms 902 may be affixed to a side of the seat 104. In some embodiments, the articulated support arms 902 may be removably affixed. The skilled person in the art will appreciate that different configurations of the articulated support arms 902 illustrated in FIGS. 9A and 9B may be considered, without limitation.

FIG. 10 is a block diagram illustrating a control module 1002 of the workstation 100 (or 800) which may be configured to turn on/off and/or adjust the intensity and/or frequency of the vibrating nodes 120 and 122. In some embodiments, the control module 1002 may be communicatively coupled to a control panel 1004 located on the workstation 100, for example on keyboard mount 128, mouse platform 130, tray 132 or at another location. Additionally or alternatively, the control module 1002 may be operated remotely via a wireless device such as a remote control 1006.

In addition, in some embodiments the workstation 100 may further comprise a power cord or similar to electrically coupled the workstation 100 to an external power source 1008 (e.g., an electrical outlet of similar). In some embodiments, the power source 1008 may be electrically coupled to a power distribution circuit 1010 of the workstation 100 that is configured to distribute electrical power to different parts thereof, including the control module 1002 and vibrating nodes 120 and 122.

In some embodiments, the power distribution circuit 1010 may also be used to distribute power to other accessories or devices, for example the display 126. In some embodiments, the workstation 100 may have one or more outlets thereon to electrically coupled thereto devices and/or accessories. In some embodiments, these may take the form of any known means of transferring electrical power in art, including USB and/USB-C connections or similar. Other embodiments may have an internal power source (not shown), such as a rechargeable battery or similar.

The foregoing descriptions of specific embodiments of the present invention have been presented for purposes of illustration and description. They are not intended to be exhaustive or to limit the invention and method of use to the precise forms disclosed. Obviously, many modifications and variations are possible in light of the above teaching. As can be understood, the examples described above are intended to be exemplary only.

The embodiments described were chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient but is intended to cover the application or implementation without departing from the spirit or scope of the claims of the present invention.

The term "connected", "attached", "affixed" or "coupled to" may include both direct coupling (in which two elements that are coupled to each other contact each other) and indirect coupling (in which at least one additional element is located between the two elements).

As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A workstation comprising:

a base;

a seat coupled to said base;

a backrest angularly coupled to said seat at a designated recline angle for receiving the user's back thereon, the backrest comprising a raised spine rest portion, centered laterally in the middle of said backrest, and extending longitudinally along a designated length of said backrest so as to have the arms and shoulders of the user offset posteriorly via the effect of gravity;

a neck rest coupled to an upper end of said backrest comprising one of more vibrating nodes thereon configured to engage with the back of the user's neck;

a headrest coupled to an upper end of the neck rest for receiving the back of the user's head thereon;

a footrest adjustably tilted and coupled to said base, the footrest having two vibrating nodes thereon, each vibrating node positioned for receiving the ball of a foot of the user thereon;

wherein the footrest is slidingly adjustable to the base;

a display mount rigidly coupled to the back of the backrest at a first end and having a second end located and configured to removably affix one or more displays thereto, wherein the one or more displays are positioned substantially parallel to the backrest, irrespective of the designated recline angle;

at least one platform for receiving an input device thereon;

wherein a mouse platform or a keyboard mount is coupled to a side of said seat and positioned so that the elbow of the user rests on the backrest while using a mouse or a keyboard.

2. The workstation of claim 1, wherein the at least one platform comprises the keyboard mount for receiving the keyboard thereon.

3. The workstation of claim 2, wherein said keyboard mount is adjustably coupled to said seat via a plurality of articulated support arms that are configured to allow the keyboard mount to be moved along six degrees of freedom.

4. The workstation of claim 2, wherein the at least one platform further comprises the mouse platform for receiving the mouse thereon.

5. The workstation of claim 4, wherein said mouse platform comprises an armrest portion for receiving the user's upper arm thereon.

6. The workstation of claim 4, wherein at least one of the mouse platform and the keyboard mount is adjustably coupled to said seat.

7. The workstation of claim 6, wherein said mouse platform and said keyboard mount are each configured to be removably affixable to either a left side or a right side of said seat.

8. The workstation of claim 1, wherein said designated recline angle is between 60 and 80 degrees.

9. The workstation of claim 8, wherein said backrest is hingedly coupled to the seat and wherein said designated recline angle is adjustable.

10. The workstation of claim 9, wherein the designated recline angle is not adjustable by more than 20 degrees.

11. The workstation of claim 1, wherein said spine rest portion further comprises a recessed channel therein extending longitudinally along the middle thereof to receive one or more spinous processes of the user therein.

12. The workstation of claim 1, wherein the spine rest portion is comprised of a pair of elongated, longitudinally extending raised portions, the lower end of the elongated raised portions are adjacent to said seat, and wherein each lateral side of the backrest further comprises one of the raised side portions of the spine rest portion, thereon.

13. The workstation of claim 1, wherein the headrest, the neck rest and an elongated raised portion are rigidly coupled and configured to be slidingly adjustable to the backrest so as to be raised or lowered with respect thereto.

14. The workstation of claim 1, wherein the footrest is tilted towards the seat to receive the entirety of the user's feet thereon so that the user's ankles are in a neutral position.

15. The workstation of claim 1, wherein the footrest is removable.

16. The workstation of claim 1, further comprising a control module communicatively coupled to at least some of the vibrating nodes of the neck rest and footrest, and operable to control a vibration frequency or intensity of said at least some of the vibrating nodes.

17. The workstation of claim 1, further comprising a tray having a tray surface substantially horizontal and the tray being coupled to a side of said seat.

18. The workstation of claim 17, wherein said tray is hingedly coupled to the side of said seat and configured to be folded between a horizontal configuration and a reclined configuration.

19. A workstation comprising:

a base;

a seat coupled to said base;

a backrest angularly coupled to said seat at a designated recline angle for receiving the user's back thereon, the backrest comprising a raised spine rest portion, centered laterally in the middle of said backrest, and extending longitudinally along a designated length of said backrest so as to have the arms and shoulders of the user offset posteriorly via the effect of gravity;

wherein the spine rest portion is comprised of a pair of elongated, longitudinally extending raised portions, the lower end of the elongated raised portions are adjacent to said seat, and wherein each lateral side of the backrest further comprises one of the raised side portions of the spine rest portion, thereon;

a neck rest coupled to an upper end of said backrest comprising one of more vibrating nodes thereon configured to engage with the back of the user's neck;

a headrest coupled to an upper end of the neck rest for receiving the back of the user's head thereon;

a footrest adjustably tilted and coupled to said base, the footrest having two vibrating nodes thereon, each vibrating node positioned for receiving the ball of a foot of the user thereon;

a display mount rigidly coupled to the back of the backrest at a first end and having a second end located and configured to removably affix one or more displays thereto, wherein the one or more displays are positioned substantially parallel to the backrest, irrespective of the designated recline angle;

at least one platform for receiving an input device thereon;

wherein a mouse platform or a keyboard mount is coupled to a side of said seat and positioned so that the elbow of the user rests on the backrest while using a mouse or a keyboard.

20. A workstation comprising:

a base;

a seat coupled to said base;

a backrest angularly coupled to said seat at a designated recline angle for receiving the user's back thereon, the backrest comprising a raised spine rest portion, centered laterally in the middle of said backrest, and extending longitudinally along a designated length of said backrest so as to have the arms and shoulders of the user offset posteriorly via the effect of gravity;

a neck rest coupled to an upper end of said backrest comprising one of more vibrating nodes thereon configured to engage with the back of the user's neck;

a headrest coupled to an upper end of the neck rest for receiving the back of the user's head thereon;

wherein the headrest, the neck rest and an elongated raised portion are rigidly coupled and configured to be slidingly adjustable to the backrest so as to be raised or lowered with respect thereto;

a footrest adjustably tilted and coupled to said base, the footrest having two vibrating nodes thereon, each vibrating node positioned for receiving the ball of a foot of the user thereon;

a display mount rigidly coupled to the back of the backrest at a first end and having a second end located and configured to removably affix one or more displays thereto, wherein the one or more displays are positioned substantially parallel to the backrest, irrespective of the designated recline angle;

at least one platform for receiving an input device thereon;

wherein a mouse platform or a keyboard mount is coupled to a side of said seat and positioned so that the elbow of the user rests on the backrest while using a mouse or a keyboard.

* * * * *